US010879580B2

(12) United States Patent
Bu et al.

(10) Patent No.: US 10,879,580 B2
(45) Date of Patent: Dec. 29, 2020

(54) DIPOLE FIXATION IN ANTENNA SYSTEM

(71) Applicant: Nokia Shanghai Bell Co., Ltd., Shanghai (CN)

(72) Inventors: Antao Bu, Shanghai (CN); Chenguang Zhou, Shanghai (CN); Ling Hu, Shanghai (CN)

(73) Assignee: NOKIA SHANGHAI BELL CO., LTD., Shanghai (CN)

( * ) Notice: Subject to any disclaimer, the term of this patent is extended or adjusted under 35 U.S.C. 154(b) by 136 days.

(21) Appl. No.: 15/108,840

(22) PCT Filed: Dec. 8, 2014

(86) PCT No.: PCT/CN2014/093234
§ 371 (c)(1),
(2) Date: Jun. 29, 2016

(87) PCT Pub. No.: WO2015/101137
PCT Pub. Date: Jul. 9, 2015

(65) Prior Publication Data

US 2016/0322696 A1 Nov. 3, 2016

(30) Foreign Application Priority Data

Dec. 31, 2013 (CN) ..... 2013 1 0752207

(51) Int. Cl.
*H01Q 1/12* (2006.01)
*H01Q 19/10* (2006.01)
(Continued)

(52) U.S. Cl.
CPC ..... *H01Q 1/1207* (2013.01); *H01Q 1/12* (2013.01); *H01Q 1/246* (2013.01); *H01Q 9/16* (2013.01); *H01Q 19/108* (2013.01); *H01Q 19/10* (2013.01)

(58) Field of Classification Search
CPC .... H01Q 1/1207; H01Q 1/246; H01Q 19/108; H01Q 9/16; H01Q 1/12; H01Q 19/10
(Continued)

(56) References Cited

U.S. PATENT DOCUMENTS 4,319,249 A * 3/1982 Evans ..... H01Q 21/062 343/703
4,623,895 A * 11/1986 Bowering ..... H01Q 1/085 343/829
(Continued)

FOREIGN PATENT DOCUMENTS

CN 2658957 Y 11/2004
CN 202150554 U 2/2012
(Continued)

OTHER PUBLICATIONS

International Search Report for PCT/CN2014/093234 dated Mar. 18, 2015.

*Primary Examiner* — Hai V Tran
(74) *Attorney, Agent, or Firm* — Fay Sharpe LLP

(57) ABSTRACT

The present invention provides a dipole fixation in an antenna system for fixing dipoles (1) on a reflector (2), the dipole fixation comprising fixing members (3) passing through apertures on the reflector (2) to fix the dipoles (1) on the reflector (2); a first non-conductive member (4) arranged between the dipoles (1) and the reflector (2); and a second non-conductive member (5) arranged between the fixing members (3) and the reflector (2). The dipole fixation of this invention avoids any metal contact between the dipoles and the reflector, guaranteeing the PIM reliability for a long time and obtaining a stable connection.

12 Claims, 3 Drawing Sheets

(51) Int. Cl.
*H01Q 9/16* (2006.01)
*H01Q 1/24* (2006.01)

(58) Field of Classification Search
USPC ..... 343/797, 818
See application file for complete search history.

(56) References Cited

U.S. PATENT DOCUMENTS 4,647,942 A * 3/1987 Counselman, III .... H01Q 1/125 343/797
6,933,906 B2 8/2005 Stolle et al.
2002/0036594 A1* 3/2002 Gyenes ..... H01Q 9/14 343/745
2004/0145531 A1* 7/2004 Godard ..... H01Q 1/1228 343/792.5
2010/0007571 A1 1/2010 Riedel
2010/0283710 A1* 11/2010 Lutman ..... H01Q 1/48 343/906
2010/0302118 A1* 12/2010 Suleiman ..... H01Q 19/30 343/808
2012/0038540 A1* 2/2012 Jacob ..... H01Q 21/26 343/878
2012/0075155 A1* 3/2012 Lindmark ..... H01Q 19/106 343/797
2017/0125917 A1* 5/2017 Lin ..... H01Q 1/246

FOREIGN PATENT DOCUMENTS

CN 202259667 U 5/2012
CN 202495565 U 10/2012
CN 103151603 A 6/2013
CN 203180087 U 9/2013
CN 103337716 A 10/2013
CN 203300808 U 11/2013
CN 103474753 A 12/2013
CN 103682561 A 3/2014
CN 203660040 U 6/2014
JP 2006246047 A 11/2006
JP 2012-519990 A 8/2012
JP 2013-062603 A 4/2013
WO WO 2005/060049 A1 6/2005

* cited by examiner

DIPOLE FIXATION IN ANTENNA SYSTEM

FIELD OF THE PRESENT INVENTION

The present invention generally relates to communications technology, and more particularly, to a dipole fixation in antenna system.

BACKGROUND OF THE PRESENT INVENTION

Base Station Antennas are indispensable devices for wireless communication system and passive intermodulation (PIM) performance of base station antennas is crucial to good communication quality. Therefore, the design of antenna arrays devotes to improve PIM performance.

In the antenna system, the dipoles are needed to be fixed on the reflector. The best existing dipole fixation way is using metal screws 3 to fix the dipoles 1 on the reflector 2, as shown in FIGS. 1 to 2. In this way, the dipoles' PIM is sensitive to the contact resistance between the dipoles 1 and the reflector 2, and the contact resistance will change when the pressure decrease if the screw 3 is loosened. Meanwhile, because the base station antennas usually work outside, so there are some oxidation products in the connection point of the dipoles 1 (metal A) to the reflector 2 (metal B) due to the humidity in the air, which will unfavorably influence the PIM performance.

In order to improve the above fixation way, presently, the screw-connect ground way was changed to capacitive coupling connecting ground and the dipoles 1 were fixed by plastic clip 4 or screw on the reflector 2, as shown in FIGS. 3 to 4. Although the PIM was improved with a great extent in this way, but the problem still exists that the plastic clip 4 or screw could be broken when there is a strong vibration, for example.

SUMMARY OF THE PRESENT INVENTION

The objective of the present invention is to solve the problems existing in the above fixation ways, and thus a new dipole fixation is proposed to avoid the possible PIM problem.

To this end, the present invention proposes a dipole fixation in an antenna system for fixing dipoles on a reflector, the dipole fixation comprising fixing members passing through apertures on the reflector to fix the dipoles on the reflector; a first non-conductive member arranged between the dipoles and the reflector; and a second non-conductive member arranged between the fixing members and the reflector. With such configuration, the non-conductive member is not only provided between the dipoles and the reflector but also between the fixing members and the reflector to avoid any direct metal contact. Moreover, the capacitive coupling connecting ground way is adopted between the dipoles and the reflector, which effectively ensures PIM reliability in the antenna system.

According to an embodiment, the fixing members are metal fixing members, such as screws or rivets, so as to ensure that the dipoles can be fixed on the reflector stably.

According to an embodiment, the first non-conductive member is a non-metal film or metal film with non-conductive treatment.

According to an embodiment, the second non-conductive member is a non-metal washer or metal washer with non-conductive treatment.

According to an embodiment, the first non-conductive member and/or the second non-conductive member is provided with a bulge axially extending into the apertures on the reflector, so as to further prevent the direct metal contact, and thus the fixing members such as metal screws cannot touch the front and back sides of the reflector.

Applying the proposed dipole fixation in antenna system of this invention provides advantages at least as follows:

1. Since the capacitive coupling connecting ground is adopted, and also no metal contact between the metal fixing members and the reflector owning to the non-conductive metal or metal washer with non-conductive treatment which has the bulge, so that very good PIM performance can be obtained;
2. The fixation way is strong enough to afford strong vibration, since the metal fixing member instead of the plastic component is adopted to tighten the dipoles on the reflector;
3. There is no oxide product between the dipoles and the reflector even the antenna system works for a long time outside, because they don't connect directly but being isolated from each other with the non-metal film or metal film with non-conductive treatment and the non-metal washer or metal washer with non-conductive treatment, so as to ensure the PIM reliability for a long time.

BRIEF DESCRIPTION OF THE DRAWINGS

The other features and advantages of the present invention will be better understood via the preferable embodiments described in detail hereinbelow with reference to the accompanying drawings. In the figures, the same reference number indicates the same or similar member, wherein.

DETAILED DESCRIPTION OF THE PREFERRED EMBODIMENTS

Next, the dipole fixation of the present invention will be described in detail with reference to the specific embodiments. In the detailed description, the directional terms, such as up, down, left and right, will be used as example by referring to the directions as shown in the figures but not used to restrict the protection scope. The exampled structural design and the following embodiments are only used to exemplarily explain the specific technical solutions of the present invention, and cannot be used to restrict the protection scope of the present invention.

Figure 1:
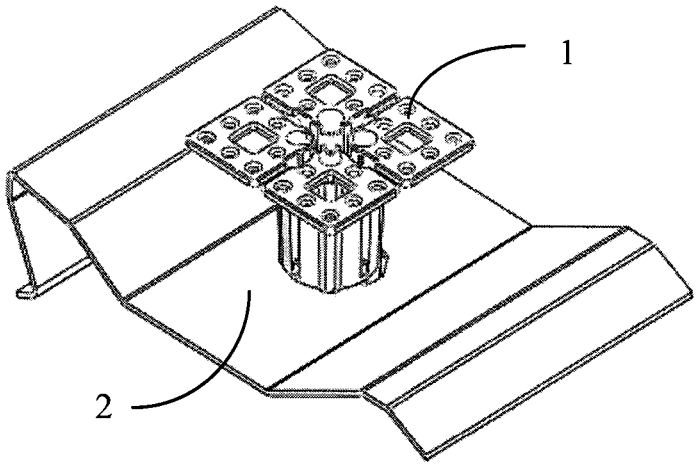
FIG. 1 is a schematic view of a dipole fixation in the prior art.
Figure 2:
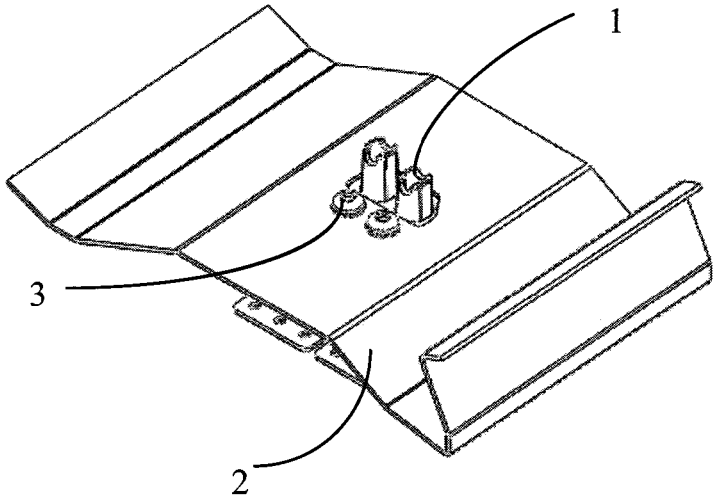
FIG. 2 is a schematic view taken from the bottom of the reflector of FIG. 1.
Figure 3:
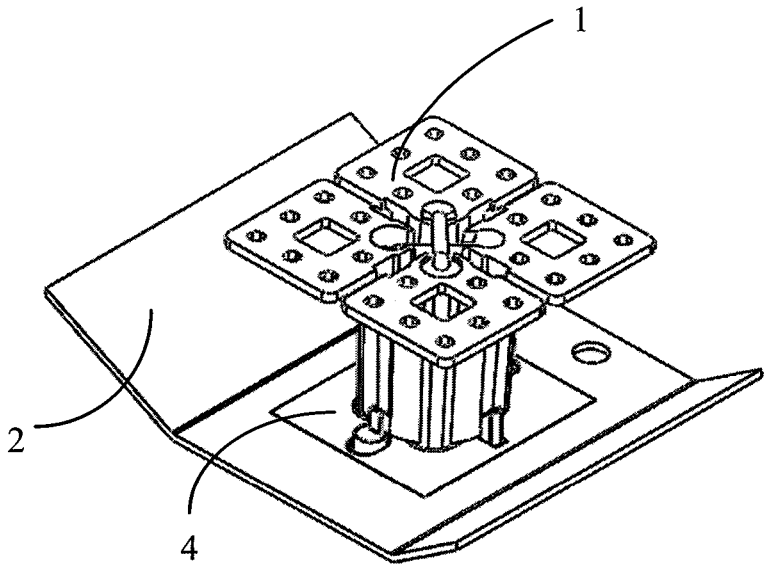
FIG. 3 is a schematic view of another dipole fixation in the prior art.
Figure 4:
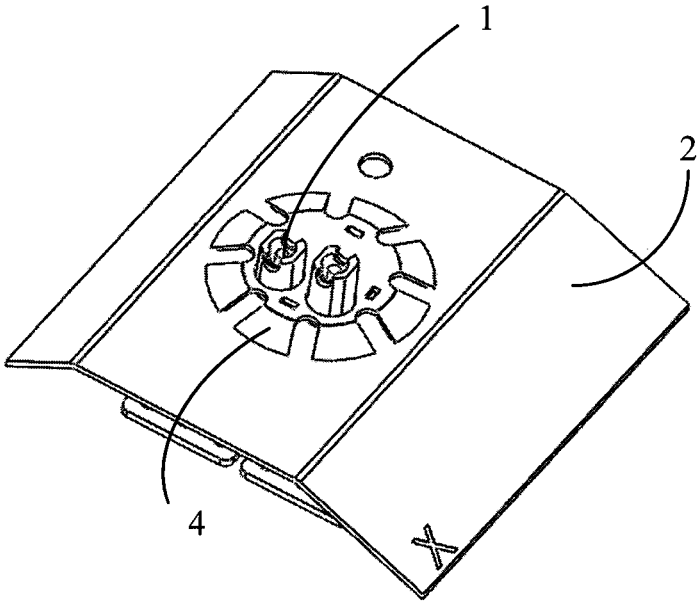
FIG. 4 is a schematic view taken from the bottom of the reflector of FIG. 3.
Figure 5:
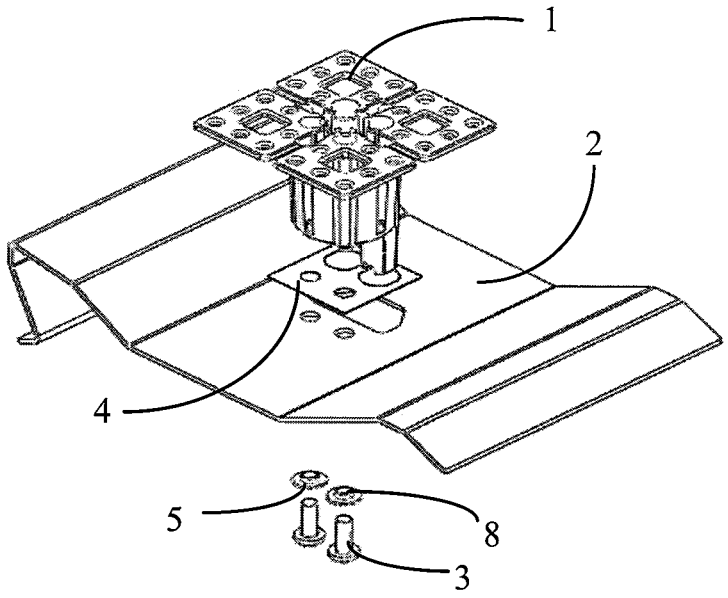
FIG. 5 is an exploded perspective view schematically illustrating a dipole fixation according to a preferred embodiment of the present invention.
Figure 6:
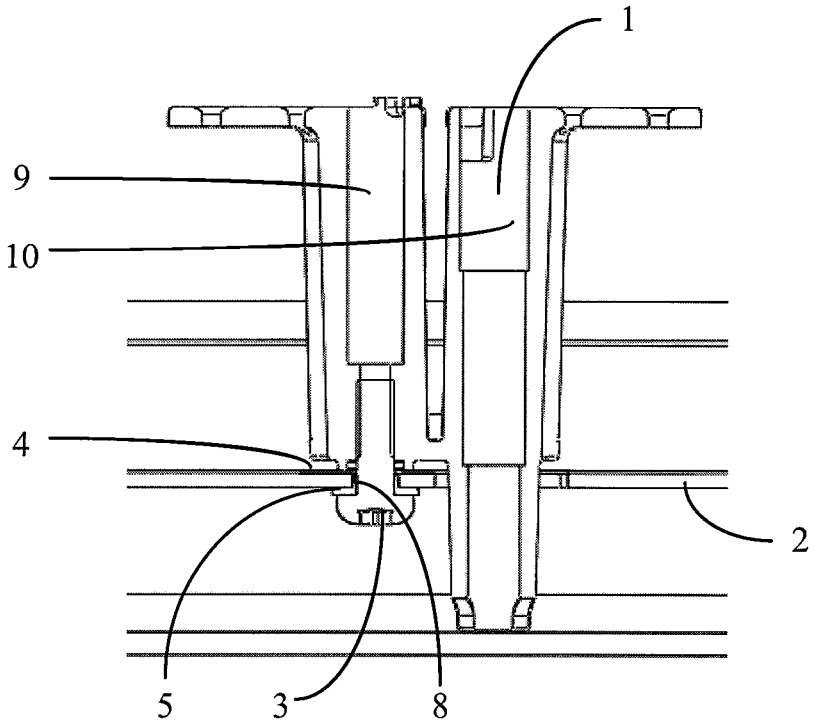
FIG. 6 is a sectional view schematically illustrating the assembled dipoles and the reflector by the dipole fixation of FIG. 5.

Now referring to FIG. 5 and FIG. 6, which schematically illustrate a dipole fixation according to a preferred embodiment of the present invention for fixing the dipoles 1 on the reflector 2. The dipole fixation comprises fixing members, such as metal screws, which can pass through the apertures on the reflector 2 and screw into the conductors 9 of the dipoles 1, so that the dipoles 1 can be fixed firmly on the reflector 2. The dipole fixation further comprises a first non-conductive member 4 arranged between the dipoles 1 and the reflector 2, such as a non-metal film or metal film with non-conductive treatment. The first non-conductive member 4 is provided with an opening through which another conductor 10 (FIG. 6) electrically connected to PCB can pass and a through-hole through which the metal screw can pass. With such configuration, the dipoles 1 and the reflector 2 can be isolated from each other by the non-metal film or metal film 4 with non-conductive treatment, so the dipoles 1 are grounded via capacitive coupling connecting. Moreover, it is advantageous that a second non-conductive member 5 is arranged between the fixing members 3 and the reflector 2, such as a non-metal washer or metal washer with non-conductive treatment. The washer 5 is also provided with through-hole for the metal screw passing through. Also, according to the present invention, a bulge 8 is preferably formed on the washer 5 by axially extending into the apertures on the reflector 2 during the assembly for separating the connecting portion of the metal screw 3 from the reflector 2 to avoid direct metal contact. It should be noted that, the above bulge is not limited to form on the washer 5, and can also form on the film 4 arranged between the dipoles 1 and the reflector 2. Optionally, both the film 4 and the washer 5 can be provided with a bulge oppositely extended. After being positioned and assembled, the stable dipole fixation way with good PIM performance is gotten. And this fixation way is easy to be assembled which has no negative effect on the dipole electrical performance.

Compared to the best existing solutions which plastic clip is easily broken under a stronger vibration or PIM is bad when the dipole is directly fixed on the reflector with metal screws, the dipole fixation way of the present invention is stable. At the same time, good PIM performance can be obtained. Further, in the fixation of the present invention, the members are configured with simple structures and easily manufactured. The strange members such as clip in the prior art can be avoided and the film and the washer can be obtained by one-step forming and cutting, so the cost-effectiveness is substantially improved.

The technical solution for PIM problem according to the present invention has a broad applicability. The PIM solving solution idea adopts capacitive coupling connecting ground way to avoid the direct metal contact, and the film and/or washer with bulge ensures the metal non-contact while the metal screw ensures stable connection, so that this invention can be widely applied in other kinds BSA antennas or other fields, such as satellite antenna, radar antenna and so on.

The technical contents and the technical features of the specific embodiments of the present invention have been disclosed, however, it should be noted that without departing the technical principle of the present invention, the person skilled in the art may make some modifications and changes to the present invention, which may be considered as a part of the protection scope of the present invention. The explanations of the above embodiments are exemplary but not restrictive, and the protection scope of the present invention is defined by the appended claims.

What is claimed is:

1. A dipole fixation in an antenna system for fixing dipoles on a reflector, the dipole fixation comprising:

fixing members passing through apertures on the reflector to fix the dipoles on the reflector;

a first non-conductive member arranged axially between and in direct contact with the dipoles and the reflector; and a second non-conductive member arranged axially between and in direct contact with the fixing members and the reflector;

wherein the fixing members and respective dipoles are not directly coupled to each other.

2. The dipole fixation of claim 1, wherein the fixing members are metal fixing members.

3. The dipole fixation of claim 1, wherein the first non-conductive member is a non-metal film.

4. The dipole fixation of claim 1, wherein the second non-conductive member is a non-metal washer.

5. The dipole fixation of claim 1, wherein the first non-conductive member is provided with a bulge axially extending into the apertures on the reflector.

6. The dipole fixation of claim 1, wherein the first non-conductive member is a metal film with non-conductive treatment.

7. The dipole fixation of claim 1, wherein the second non-conductive member is a metal washer with non-conductive treatment.

8. The dipole fixation of claim 1, wherein the second non-conductive member is provided with a bulge axially extending into the apertures on the reflector.

9. A dipole fixation in an antenna system for fixing dipoles on a reflector, the dipole fixation comprising:

fixing members passing through apertures on the reflector to fix the dipoles on the reflector;

a first non-conductive member arranged axially between and in direct contact with the dipoles and the reflector; and a second non-conductive member arranged axially between and in direct contact with the fixing members and the reflector;

wherein the first non-conductive member comprises a metal film with a non-conductive treatment.

10. The dipole fixation of claim 9, wherein the second non-conductive member is a metal washer with non-conductive treatment.

11. The dipole fixation of claim 10, wherein the second non-conductive member is provided with a bulge axially extending into the apertures on the reflector.

12. The dipole fixation of claim 9, wherein the second non-conductive member is provided with a bulge axially extending into the apertures on the reflector.

* * * * *